US009272291B2

(12) United States Patent
Miller et al.

(10) Patent No.: US 9,272,291 B2
(45) Date of Patent: Mar. 1, 2016

(54) STAGED ELECTROSTATIC PRECIPITATOR

(71) Applicants: Stanley J. Miller, Grand Forks, ND (US); Jay C. Almlie, East Grand Forks, MN (US); Ye Zhuang, Grand Forks, ND (US)

(72) Inventors: Stanley J. Miller, Grand Forks, ND (US); Jay C. Almlie, East Grand Forks, MN (US); Ye Zhuang, Grand Forks, ND (US)

(73) Assignee: Energy & Environmental Research Center Foundation, Grand Forks, ND (US)

( * ) Notice: Subject to any disclaimer, the term of this patent is extended or adjusted under 35 U.S.C. 154(b) by 228 days.

(21) Appl. No.: 13/829,352

(22) Filed: Mar. 14, 2013

(65) Prior Publication Data

US 2014/0053727 A1 Feb. 27, 2014

Related U.S. Application Data

(60) Provisional application No. 61/693,518, filed on Aug. 27, 2012.

(51) Int. Cl.
*B03C 3/36* (2006.01)
*B03C 3/08* (2006.01)
(Continued)

(52) U.S. Cl.
CPC . *B03C 3/361* (2013.01); *B03C 3/08* (2013.01); *B03C 3/366* (2013.01); *B03C 3/41* (2013.01); *B03C 3/47* (2013.01); *B03C 2201/08* (2013.01); *Y10T 29/49826* (2015.01)

(58) Field of Classification Search
CPC combination set(s) only.
See application file for complete search history.

(56) References Cited

U.S. PATENT DOCUMENTS 1,427,370 A * 8/1922 Fortescue ..... 96/62
2,575,181 A * 11/1951 Mack ..... 52/581
2,602,519 A * 7/1952 Raper ..... 52/671
(Continued)

FOREIGN PATENT DOCUMENTS

DE 3535826 A1 4/1987
EP 0525283 B1 2/1993
(Continued)

OTHER PUBLICATIONS

International Application Serial No. PCT/US2013/031672, International Preliminary Report on Patentability mailed Mar. 12, 2015, 9 pgs.
(Continued)

*Primary Examiner* — Christopher P Jones
*Assistant Examiner* — Sonji Turner
(74) *Attorney, Agent, or Firm* — Schwegman Lundberg & Woessner, P.A.

(57) ABSTRACT

A device includes a chamber having an air inlet and an air outlet. The device includes a plurality of stages including at least a first stage adjacent a second stage. The plurality of stages are disposed in the chamber and each stage has a plurality of discharge electrodes disposed in an interior region and is bounded by an upstream baffle on an end proximate the air inlet and bounded by a downstream baffle on an end proximate the air outlet. Each stage has at least one sidewall between the upstream baffle and the downstream baffle. The sidewall is configured as a collection electrode and has a plurality of apertures disposed along a length between the upstream baffle and the downstream baffle. The upstream baffle of the first stage is positioned in staggered alignment relative to the upstream baffle of the second stage and the downstream baffle of the first stage are positioned in staggered alignment relative to the downstream baffle of the second stage.

20 Claims, 4 Drawing Sheets

(51) Int. Cl.
*B03C 3/41* (2006.01)
*B03C 3/47* (2006.01)

(56) References Cited

U.S. PATENT DOCUMENTS

| | | | | | |
|---|---|---|---|---|---|
| 2,884,087 | A | * | 4/1959 | Matts | 96/32 |
| 3,733,785 | A | * | 5/1973 | Gallaer | 96/64 |
| 3,807,140 | A | * | 4/1974 | Gurvits et al. | 96/64 |
| 3,966,435 | A | * | 6/1976 | Penney | 96/66 |
| 3,985,524 | A | * | 10/1976 | Masuda | 96/32 |
| 4,097,252 | A | * | 6/1978 | Kirchhoff et al. | 96/74 |
| 4,725,289 | A | * | 2/1988 | Quintilian | 95/76 |
| 5,076,820 | A | * | 12/1991 | Gurvitz | 96/72 |
| 5,156,658 | A | | 10/1992 | Riehl | |
| 5,484,473 | A | * | 1/1996 | Bontempi | 96/65 |
| 5,547,495 | A | | 8/1996 | Wright | |
| 5,547,496 | A | * | 8/1996 | Hara | 96/79 |
| 5,922,111 | A | * | 7/1999 | Omi et al. | 96/60 |
| 5,928,592 | A | * | 7/1999 | Nojima | 264/241 |
| 5,961,693 | A | * | 10/1999 | Altman et al. | 95/78 |
| 6,096,118 | A | * | 8/2000 | Altman et al. | 96/50 |
| 6,544,317 | B2 | * | 4/2003 | Miller | 95/63 |
| 7,901,489 | B2 | * | 3/2011 | Jin et al. | 96/30 |
| 8,328,902 | B2 | * | 12/2012 | Boyden et al. | 95/5 |
| 8,574,353 | B2 | * | 11/2013 | Nazuka et al. | 96/62 |
| 2002/0134237 | A1 | | 9/2002 | Miller | |
| 2010/0154642 | A1 | * | 6/2010 | Jin et al. | 96/32 |
| 2011/0209620 | A1 | * | 9/2011 | Nazuka et al. | 96/62 |

FOREIGN PATENT DOCUMENTS

| | | | | |
|---|---|---|---|---|
| EP | 1946845 | A1 | | 7/2008 |
| GB | 679133 | | * | 9/1952 |
| GB | 726513 | | | 3/1955 |
| GB | 935795 | | | 9/1963 |
| JP | 2004-174456 | | * | 6/2004 |
| JP | 2009090166 | A | | 4/2009 |
| WO | WO-2011113963 | A1 | | 5/2011 |
| WO | WO-2014035477 | A1 | | 3/2014 |

OTHER PUBLICATIONS

International Application Serial No. PCT/US2013/031672, International Search Report mailed Jun. 14, 2013, 5 pgs.

International Application Serial No. PCT/US2013/031672, Written Opinion mailed Jun. 14, 2013, 7 pgs.

Wolf, D., et al., "Pulse Jet Fabric Filter Retrofit and Results at Craig Station Units 1 & 2", (Abstract), Combined Power Plant Air Pollution Control Mega Symposium, Washington, DC, Aug. 30-Sep. 2, 2004., 1 pg.

* cited by examiner

STAGED ELECTROSTATIC PRECIPITATOR

CLAIM OF PRIORITY

This patent application claims the benefit of priority of U.S. Provisional Patent Application Ser. No. 61/693,518 filed on Aug. 27, 2012, which is hereby incorporated by reference in its entirety.

STATEMENT REGARDING FEDERALLY SPONSORED RESEARCH OR DEVELOPMENT

This invention was made with Government support under award number National Energy Technology Laboratory Cooperative Agreement No. DE-FC26-98FT40320 awarded by U.S. Department of Energy (DOE). The Government has certain rights in the invention.

BACKGROUND

Coal-fired power plants are ordinarily equipped with a filtration system to limit particulate matter emissions. A baghouse filter and a cyclone-type collector are two types of systems employed to limit stack emissions.

An electrostatic precipitator is another example of a system to reduce emissions. Many such ESP systems, however, are inadequate to meet industry standards for fine particle collection efficiency.

Overview

The present inventors have recognized, among other things, that a problem to be solved can include providing high efficiency filtration for coal-fired boilers. The present subject matter can help provide a solution to this problem, such as by providing a system configuration and airflow geometry to achieve new levels of efficiency.

In addition, the present inventors have recognized a problem in maintaining aging equipment and meeting new standards. One example of the present subject matter includes equipment and systems to retrofit an existing structure.

An example includes a system having a series of stages with staggered alignment and perforated collection electrodes arranged in a manner to improve collection efficiency.

An example can be operated using different combustion coal flue gases with different fly ash resistivities. Design parameters can be evaluated under various operating conditions to optimize particulate matter (PM) collection performance. Particulate sampling data, including aerodynamic particle sizer, scanning mobility particle sizer, and regulatory data, can be collected to determine PM emissions of the staged ESP configurations.

One configuration of the present subject matter includes an arrangement of precipitation electrodes and precipitation collection plates that direct flow in a particular path, which facilitates higher PM collection levels, even for particles at submicron size.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
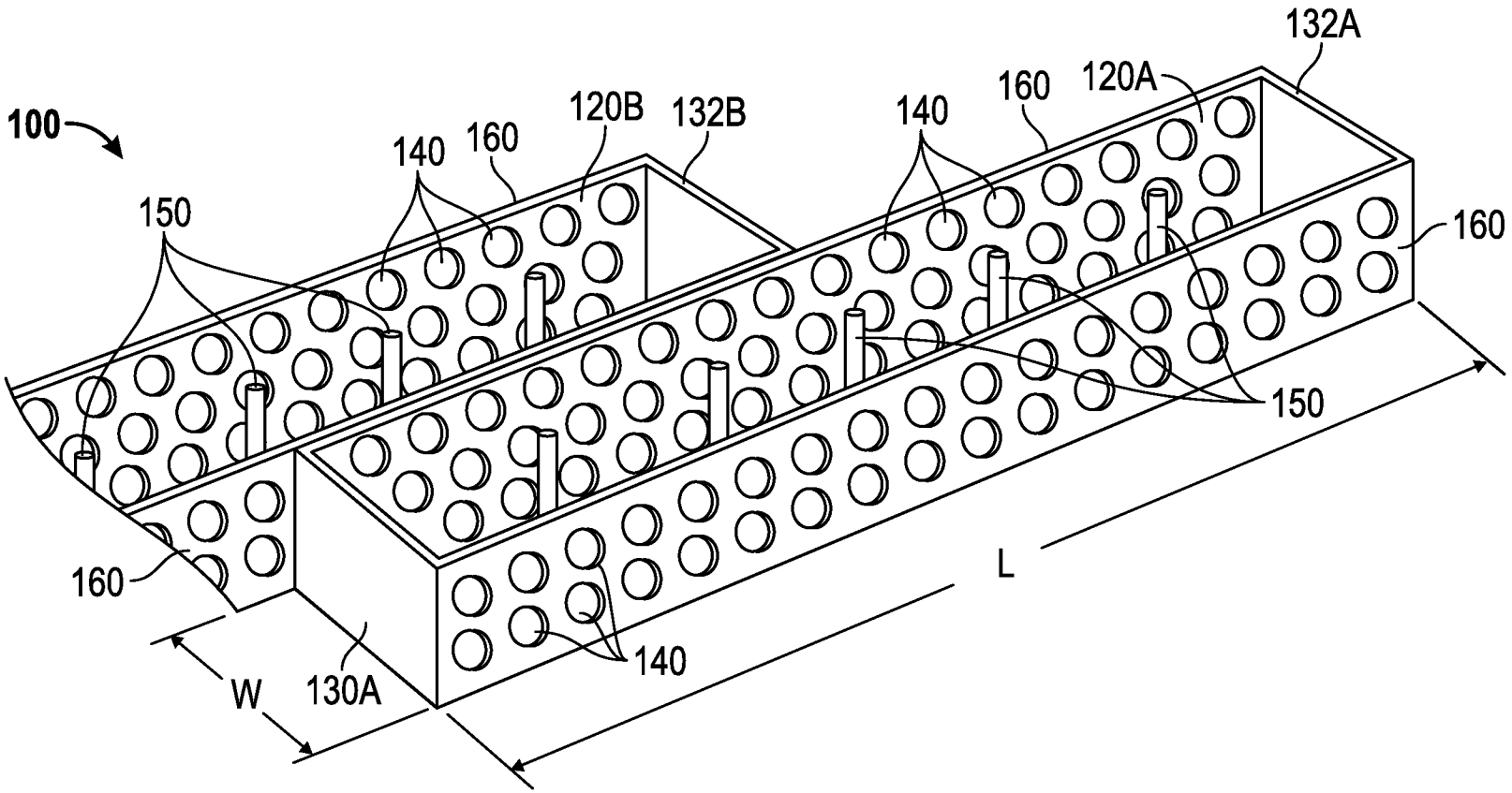
FIG. 1 includes a view of a portion of an electrostatic precipitator, according to one example.

FIG. 1 includes a view of portion 100 of an electrostatic precipitator, according to one example. Portion 100 includes stage 120A and stage 120B. Stage 120A includes baffle 132A and baffle 130A on opposite ends. In this view, consider the airflow to travel from near baffle 130A to near baffle 132A, in which case, baffle 130A can be viewed as an upstream baffle and baffle 132A can be viewed as a downstream baffle. Baffle 130A and baffle 132A are impervious to air in that they can be fabricated of a solid material and have their vertical edges bonded to sidewalls 160 in the manner shown in the figure. Sidewalls 160 are perforated with apertures 140. In the example shown, apertures are circular openings however, other configurations are also contemplated, including slots.

Sidewalls 160 are fabricated of an electrically conductive material and are configured as collector electrodes. A plurality of discharge electrodes 150 is disposed within the interior of stages 120A and 120B. Discharge electrodes 150 are configured to ionize nearby particles and sidewalls 160 (functioning as collector electrodes) captures the charged particles.

As shown in the figure, baffle 132B of stage 120B is located proximate to the middle of length L of stage 120A.

Stage 120A has a width dimension of W and a length dimension of L. A ratio of L/W is approximately 40:1, however, other ratios are also contemplated.

Figure 2:
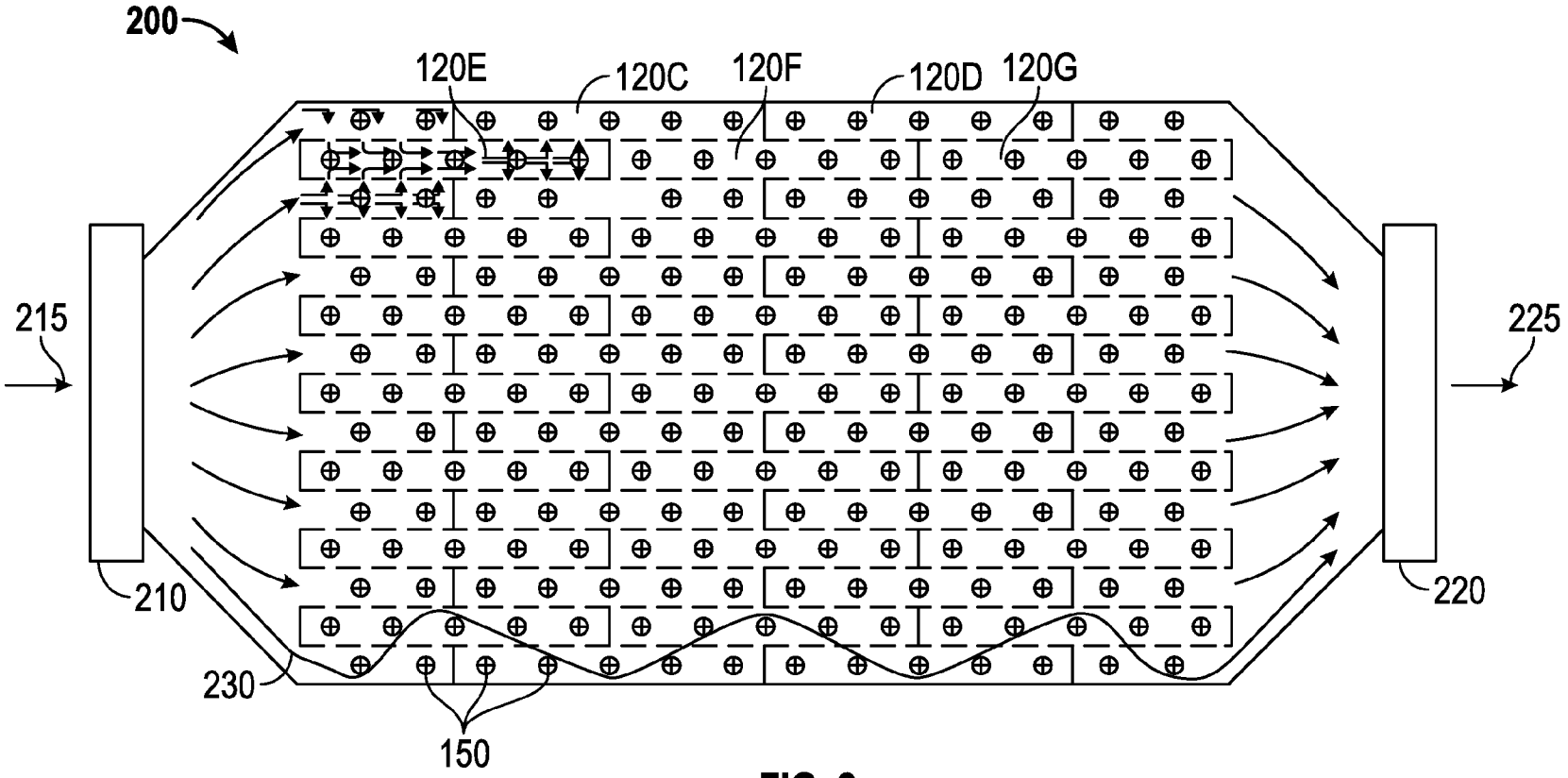
FIG. 2 includes a schematic of an electrostatic precipitator, according to one example.

FIG. 2 includes a schematic of electrostatic precipitator 200, according to one example. Precipitator 200 includes inlet 210 configured to receive intake air with a flow direction indicated by arrow 215. Precipitator 200 includes outlet 220 configured to discharge air with a flow direction indicated by arrow 225. Precipitator 200 includes an array of stages, some of which are labeled as stages 120C, 120D, 120E, 120F, and 120G. The stages of precipitator 200 are arranged in 15 rows with baffles in staggered alignment. In this manner, the stages are arranged in a manner akin to a running bond.

Intake air is routed to the exposed sidewall portions of stage 120E and other stages arranged in alternating rows, as illustrated. Flow pathway 230 is representative and indicates the serpentine route from inlet 210, past the discharge electrodes 150, into a stage by way of an exposed sidewall, followed by alternating exit and entry of stages by way of sidewall apertures. Transverse baffles disposed at opposing ends of each stage prevent discharge in a direction parallel with the overall airflow direction as indicated by arrow 215 and arrow 225.

Figure 3:
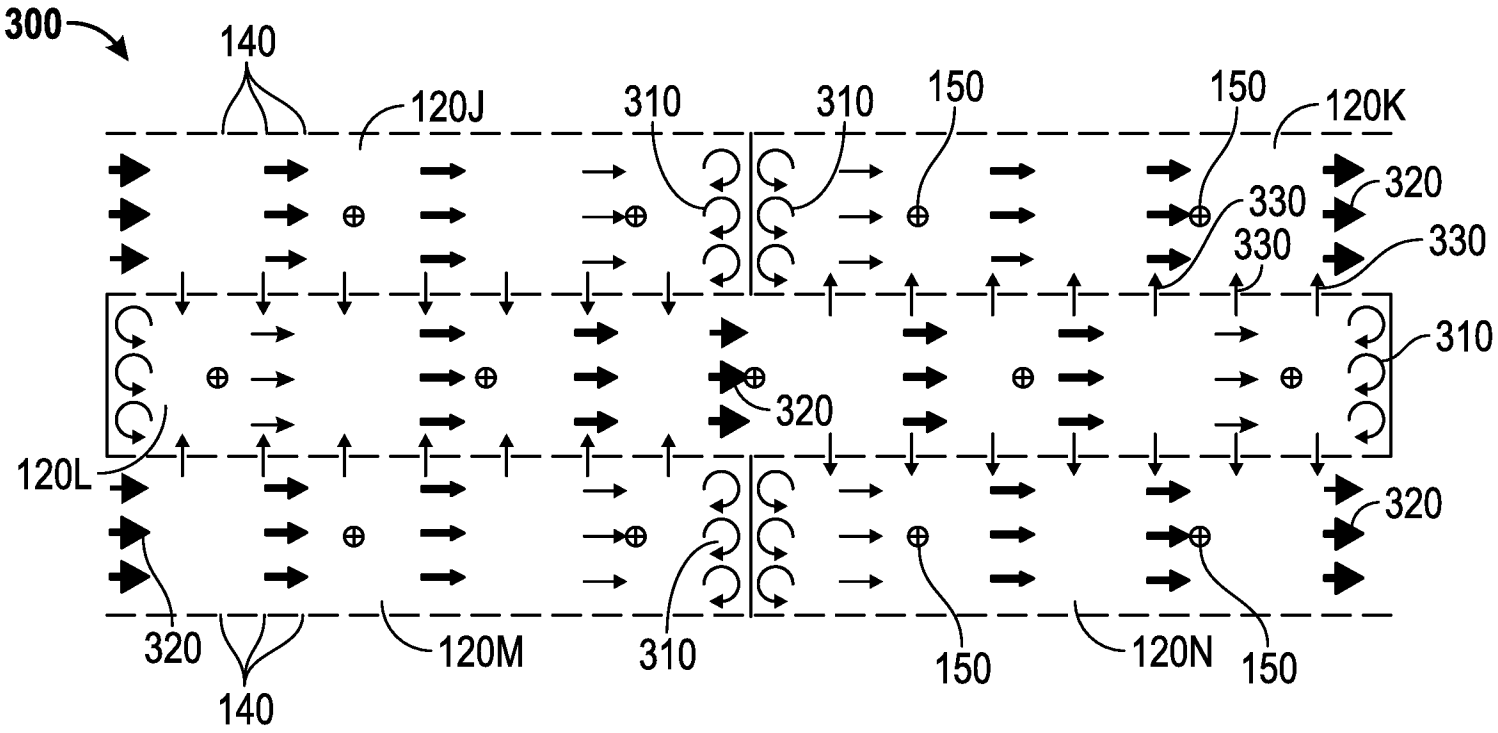
FIG. 3 includes a schematic view of a portion of an electrostatic precipitator, according to one example.

FIG. 3 includes a schematic view of portion 300 of an electrostatic precipitator, according to one example. In the example shown, portion 300 illustrates three rows of stages in which the full length of stage 120L is shown along with approximately half portions of stages 120J, 120K, 120M and 120N. In the figure, stage 120L is adjacent to stages 120J, 120K, 120M and 120N.

Airflow in stage 120J travels rightward in the figure and, as indicated by the gradation in arrow weight, has a greatest velocity near the middle of the length of stage 120J (left edge of the figure) and decelerates to a minimum velocity as shown by the turbulent flow at 310, near the transverse baffle. Air in stage 120J passes through apertures 140 in the sidewall and passes into stage 120L. As shown, airflow near the transverse baffle of stage 120L is turbulent and accelerates to a maximum velocity as shown at 320. In a similar manner, air in stage 120K passes through apertures 140 in the direction shown, and reaches a maximum velocity at 320.

Discharge electrodes 150 in the various stages serves to ionize the particles in the airflow and upon passage through apertures 140 in the sidewalls, the particles give up their charge.

As shown in the figure, the airflow passes through the various stages by way of the sidewall apertures. The air-impervious baffles at the upstream and downstream positions preclude straight-line flow and compel the air to change direction and discharge through the sidewall apertures.

FIGS. 1, 2, and 3 illustrate examples of the present subject matter and for purposes of clarity, a cover plate is omitted in these views.

Figure 4:
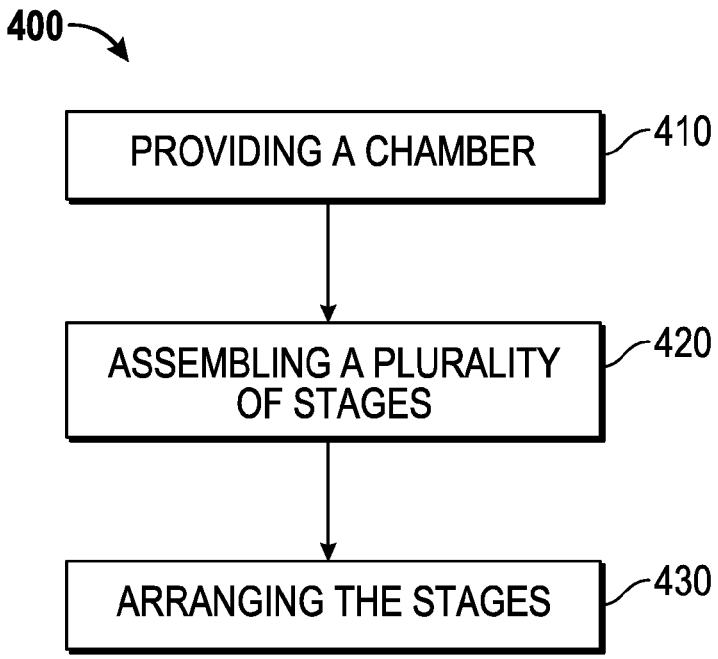
FIG. 4 includes a flow chart of a method, according to one example.

FIG. 4 includes a flow chart of method 400, according to one example. Method 400 describes a method of manufacturing an electrostatic precipitator.

At 410, method 400 includes providing a chamber. The chamber can be part of a particle filtration system at a coal-fired power plant. The chamber has an air inlet and an air outlet. The chamber can be configured with a plenum on the inlet side and on the outlet side. One example includes a transition from a round duct to a rectangular profile. The chamber can be mounted on a framework of legs. The chamber can be fabricated of metal.

At 420, method 400 includes assembling a plurality of stages. The stages can be assembled and placed in the chamber. In one example, the plurality of stages includes adjacent stages having shared sidewalls. The stages are fitted with at least one discharge electrode in an interior region. A stage can be rectangular in form and have an upstream baffle (at an end nearest to the inlet) and a downstream baffle (at an end nearest to the outlet). The stage can have at least one sidewall extending between the upstream baffle and the downstream baffle. The sidewall can have a plurality of apertures. As shown in FIG. 1, the apertures can be circular in profile and uniformly distributed along the length of the sidewall. The sidewall can be configured as a collection electrode. The discharge electrode and the collection electrode are configured to ionize and capture contaminants in the air flowing through the chamber.

At 430, method 400 includes arranging the upstream baffle and the downstream baffle of the stages in a manner such that a baffle in one row of stages is adjacent a region of peak airflow velocity in an adjacent row of stages. This staggered alignment of the baffles produces a pattern of stages that resembles a brickwork style known as running bond. The staggered arrangement provides a circuitous pathway for air passing through the sidewalls of the array of stages.

The airflow velocity is modulated by the array of baffles and the perforations in the sidewalls provide good exposure of the moving air to a collection electrode.

With a plurality of stages having uniform length, the stages can be configured so that baffles are aligned with the approximately middle region of each adjacent stage. The stages of a precipitator can have varying lengths with baffles distributed at selected locations to provide an airflow pattern conducive to efficient precipitator operation. The sidewalls of adjacent stages can be common along any portion of their length with one example having shared half-lengths.

The baffles at the ends of each stage are coupled to the sidewalls in a manner that promotes airflow through the sidewalls and impairs or precludes airflow through the baffles. In this manner, the airflow is routed through the apertures of the sidewall.

Figure 5:
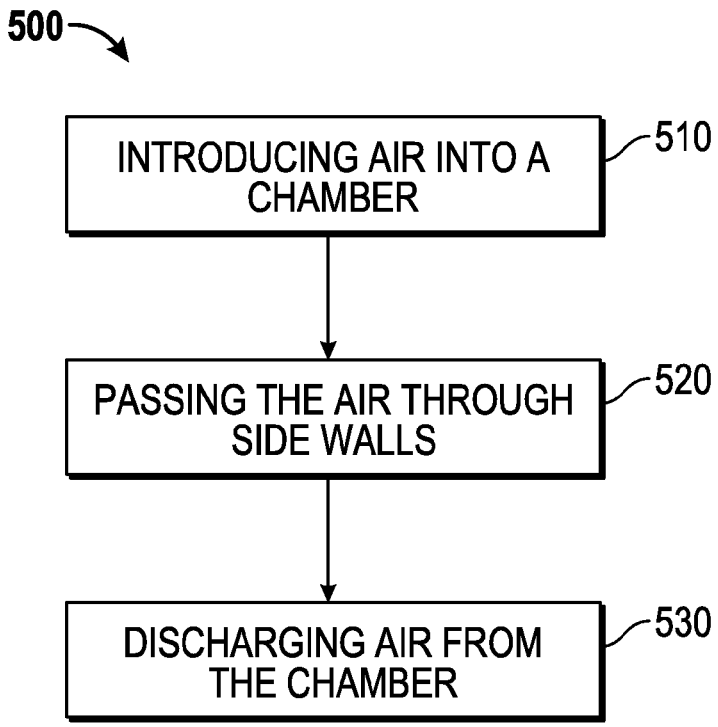
FIG. 5 includes a flow chart of a method, according to one example.

FIG. 5 includes a flow chart of method 500, according to one example. Method 500 describes a method of using an electrostatic precipitator.

Method 500, at 510 includes introducing air into an inlet of a chamber. The air can include exhaust air from a coal-fired boiler. At 520, the air is directed to pass through sidewalls of a plurality of stages in an electrostatic precipitator. The stages include a first stage positioned adjacent a second stage. Each has a plurality of discharge electrodes positioned within an interior region. Each stage has an upstream baffle (on one end of a stage located near the air inlet) and a downstream baffle (on an end located near the air outlet) and a sidewall positioned between the baffles. The stages are arranged in a staggered alignment in the chamber with baffles in one row aligned with middle portions of stage in an adjacent row.

The sidewall of a stage is configured as a collection electrode and has a plurality of apertures. The apertures are distributed along the length of the stage in the area between the upstream baffle and the downstream baffle.

At 530, method 500 includes discharging air from an outlet of the chamber. The discharge air passes through a sidewall of a stage before exiting the chamber.

The discharge electrodes inside the stages ionize the particles in the air near the electrode. The charged particles are carried from the stages by passing the apertures in the sidewalls. The sidewalls are configured as collection electrodes and air passing through the apertures brings the charged particles in close relation with the sidewalls. Air is deionized as it passes through the sidewalls. The baffles on the ends of the stages are configured to preclude airflow and force the discharge air to pass through the sidewalls. In this manner, air passing through a stage is routed through the sidewalls and brought into close proximity with the electrical elements of the electrostatic precipitator.

Various Notes & Examples

In one example, the apertures of the sidewall have a gradient along a length of a stage. The aperture sizes and aperture spacing can be graduated to selectively filter particular particle sizes and can be used for collecting or classifying particles. An example of the present subject matter can be applied to general particulate matter emissions control, ultrafine particulate matter emissions control, and powder classifying applications (systems to separate ranges of powder particle size), as an electrostatic sieve.

An example of the present subject matter is configured to maintain a high level of filtration efficiency notwithstanding accumulated particles. As accumulations are deposited on the walls of an aperture, the aperture patency will drop and raise the flow resistance through that aperture. As a natural consequence, airflow will shift to a path of less resistance and particle accumulations will ensue at a different aperture. In this manner, the flow is self-adjusting and the apertures will build-up and accumulate until all apertures are occluded.

The baffles and sidewalls of the present subject matter can be fabricated of sheet material or reinforced electrically conductive stock.

The staggered alignment of the stages of one example creates a zigzag flow pattern with nearly perpendicular flow through the collection plate apertures at a very low traversal flow rate.

One example of the present subject matter is configured to fit within a cabinet or structure of an existing electrostatic precipitator. In this manner, a precipitator can be retrofitted to increase collection efficiency.

An example of the present subject matter includes sidewalls perforated with approximately 1-inch diameter holes with approximately 50% open area. Other hole shapes and hole sizes are also contemplated, and in some examples, the holes are in the range of ¼ inch to several inches in diameter.

The flow pattern in one example is baffled so that air is forced through the perforations in the plates multiple times in a zigzag pattern, which facilitates removal of charged particles from the flue gas. Forcing of all the flow through the plates to within a short distance from a grounded surface means that the charged particles have a shorter distance of crossing streamlines to reach a grounded surface.

An example of the present subject matter includes an apparatus for enhanced collection of fine particulate matter via electrostatic precipitation. In one example, decreased particle migration distances are provided and multiple passes are utilized to increase collection efficiency. In one example, the apparatus includes multiple zones of near-infinite specific collection area (SCA) and very low velocity to increase apparent residence times of particles entering those zones.

To achieve decreased particle migration distances, the particle-laden flow is forced through repeated series of perforated and electrically grounded plates that act as electrostatic collection surfaces. Corona generated by rows of discharge electrodes parallel to the perforated plates charges particulate matter. The particulate matter then seeks a grounded surface to resolve the resulting charge. Because the particles are forced with gas flow through holes, the distance across gas streamlines that the particle must travel to reach the grounded surface is reduced greatly, as compared with a traditional ESP chamber with grounded collection sheets and walls. This process is then repeated numerous times as the gas flow and remaining uncollected particles are forced through a zigzag motion back and forth between individual cells of the staged ESP.

To achieve near-infinite SCA and very low gas/particle velocity, the celled nature of the staged ESP provides numerous non-perforated walls that slow the transverse component of the velocity vector to near zero, creating several zones of near-zero gas/particle velocity, thus increasing the effect of particle charging and electrostatic precipitation. Further, the staggered cell arrangement creates one or more low transverse velocity zones immediately adjacent to one or more high transverse velocity zones. Thus, when the lateral component of the net gas/particle field movement pushes the particles through the perforated collection plates, the particles may move from a high velocity zone, where charging and precipitation are diminished, to a low velocity zone, where particle charging and precipitation are greatly increased.

Example 1 can include or use subject matter such as an electrostatic precipitator having a chamber and a plurality of stages. The chamber has an air inlet and an air outlet. The plurality of stages includes at least a first stage adjacent a second stage. The plurality of stages is disposed in the chamber. Each stage has a plurality of discharge electrodes disposed in an interior region and is bounded by an upstream baffle (on an end proximate the air inlet) and bounded by a downstream baffle (on an end proximate the air outlet). Each stage has at least one sidewall between the upstream baffle and the downstream baffle. The sidewall is configured as a collection electrode and has a plurality of apertures located along a length between the upstream baffle and the downstream baffle. The upstream baffle of the first stage is positioned in staggered alignment relative to the upstream baffle of the second stage. The downstream baffle of the first stage is positioned in staggered alignment relative to the downstream baffle of the second stage.

Example 2 can include or can optionally be combined with the subject matter of Example 1 to optionally include wherein a middle of the sidewall of the first stage is adjacent an upstream baffle of the second stage.

Example 3 can include or can optionally be combined with the subject matter of any one of Example 1 or 2 wherein the apertures of the plurality of apertures of at least one stage are uniform in size.

Example 4 can include or can optionally be combined with the subject matter of any one of Examples 1-3 wherein the apertures of the plurality of apertures of at least one stage are uniformly distributed on the sidewall.

Example 5 can include or can optionally be combined with the subject matter of any one of Examples 1-4 wherein an area of the plurality of apertures of at least one sidewall is approximately 50% of the sidewall area.

Example 6 can include or can optionally be combined with the subject matter of any one of Examples 1-5 wherein the first stage has a width determined by a distance between a first sidewall and a second sidewall and wherein a length of the first sidewall is approximately 40 times greater than the width.

Example 7 can include or can optionally be combined with the subject matter of any one of Examples 1-6 wherein at least one of the upstream baffle and the downstream baffle is impervious to airflow.

Example 8 can include or can optionally be combined with the subject matter of any one of Examples 1-7 wherein the stages of the plurality of stages are of uniform size and shape and wherein the upstream baffles and the downstream baffles are in staggered alignment.

Example 9 can include or can optionally be combined with the subject matter of any one of Examples 1-8 wherein a portion of the at least one sidewall is common to the first stage and to the second stage.

Example 10 can include or use subject matter such as a method of fabricating an electrostatic precipitator, the method including providing a chamber having an air inlet and an air outlet, assembling a plurality of stages and arranging the stages. The plurality of stages includes at least a first stage adjacent a second stage. The plurality of stages is disposed in the chamber and each stage has a plurality of discharge electrodes within an interior region. Each stage is bounded by an upstream baffle (on an end proximate the air inlet) and bounded by a downstream baffle (on an end proximate the air outlet) and has at least one sidewall between the air inlet and the air outlet. The sidewall is configured as a collection electrode and has a plurality of apertures located along a length between the upstream baffle and the downstream baffle. The method includes arranging the upstream baffle of the first stage in staggered alignment relative to the upstream baffle of the second stage. The method includes arranging the downstream baffle of the first stage in staggered alignment relative to the downstream baffle of the second stage.

Example 11 can include or can optionally be combined with the subject matter of Example 10 wherein arranging includes configuring the upstream baffle of the first stage proximate a middle of the sidewall of the second stage.

Example 12 can include or can optionally be combined with the subject matter of any one of Example 10 or 11 wherein arranging includes configuring a portion of the at least one sidewall in common with the first stage and with the second stage.

Example 13 can include or can optionally be combined with the subject matter of any one of Examples 10-12 wherein assembling includes providing an upstream baffle substantially impervious to airflow and a downstream baffle substantially impervious to airflow.

Example 14 can include or use subject matter such as a method of operating an electrostatic precipitator, the method comprising introducing air into an inlet of a chamber, passing air through the plurality of stages, and discharging air from an outlet of the chamber. Passing air through sidewalls of a plurality of stages includes passing air through at least a first stage adjacent a second stage. The plurality of stages is disposed in the chamber and each stage has a plurality of discharge electrodes within an interior region. Each stage is bounded by an upstream baffle (on an end proximate the air inlet) and bounded by a downstream baffle (on an end proximate the air outlet). Each stage has at least one sidewall between the air inlet and the air outlet. The sidewall is configured as a collection electrode and has a plurality of apertures located along a length between the upstream baffle and the downstream baffle. The upstream baffle of the first stage is positioned in staggered alignment relative to the upstream baffle of the second stage. The downstream baffle of the first stage is positioned in staggered alignment relative to the downstream baffle of the second stage.

Example 15 can include or can optionally be combined with the subject matter of Example 14 to optionally include ionizing the air proximate the discharge electrodes.

Example 16 can include or can optionally be combined with the subject matter of any one of Example 14 or 15 to optionally include deionizing the air at the time of passing through the collection electrode.

Example 17 can include or can optionally be combined with the subject matter of any one of Example 14-16 to optionally include wherein air proximate a downstream baffle of a first stage is passed into a second stage adjacent the first stage at a middle of a sidewall of the second stage.

Example 18 can include or can optionally be combined with the subject matter of any one of Example 14-17 to optionally include wherein air enters a stage at a sidewall and air exits the stage at a sidewall.

Example 19 can include or can optionally be combined with the subject matter of any one of Example 14-18 to optionally include blocking passage of air at the upstream baffle and at the downstream baffle.

Example 20 can include or can optionally be combined with the subject matter of any one of Example 14-19 to optionally include wherein passing the air through sidewalls includes passing air through a portion of the at least one sidewall in common with the first stage and with the second stage.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. An electrostatic precipitator comprising:

a chamber having an air inlet and an air outlet;

a plurality of stages including at least a first stage adjacent a second stage, the plurality of stages disposed in the chamber and each stage having a plurality of discharge electrodes disposed in an interior region and bounded by an upstream baffle on an end proximate the air inlet and bounded by a downstream baffle on an end proximate the air outlet and having at least one sidewall between the upstream baffle and the downstream baffle, the sidewall configured as a collection electrode and having a plurality of apertures disposed along a length between the upstream baffle and the downstream baffle; and wherein the upstream baffle of the first stage is positioned in staggered alignment relative to the upstream baffle of the second stage and the downstream baffle of the first stage is positioned in staggered alignment relative to the downstream baffle of the second stage.

2. The precipitator of claim 1 wherein a middle of the sidewall of the first stage is adjacent an upstream baffle of the second stage.

3. The precipitator of claim 1 wherein the apertures of the plurality of apertures of at least one stage are uniform in size.

4. The precipitator of claim 1 wherein the apertures of the plurality of apertures of at least one stage are uniformly distributed on the sidewall.

5. The precipitator of claim 1 wherein an area of the plurality of apertures of at least one sidewall is approximately 50% of the sidewall area.

6. The precipitator of claim 1 wherein the first stage has a width determined by a distance between a first sidewall and a second sidewall and wherein a length of the first sidewall is approximately 40 times greater than the width.

7. The precipitator of claim 1 wherein at least one of the upstream baffle and the downstream baffle is impervious to airflow.

8. The precipitator of claim 1 wherein the stages of the plurality of stages are of uniform size and shape and wherein the upstream baffles and the downstream baffles are in staggered alignment.

9. The precipitator of claim 1 wherein a portion of the at least one sidewall is common to the first stage and to the second stage.

10. A method of fabricating an electrostatic precipitator, comprising:

providing a chamber having an air inlet and an air outlet;

assembling a plurality of stages in the chamber, the plurality of stages including at least a first stage adjacent a second stage, the plurality of stages disposed in the chamber and each stage having a plurality of discharge electrodes disposed in an interior region and bounded by an upstream baffle on an end proximate the air inlet and bounded by a downstream baffle on an end proximate the air outlet and having at least one sidewall between the air inlet and the air outlet, the sidewall configured as a collection electrode and having a plurality of apertures disposed along a length between the upstream baffle and the downstream baffle; and arranging the upstream baffle of the first stage in staggered alignment relative to the upstream baffle of the second stage and arranging the downstream baffle of the first stage in staggered alignment relative to the downstream baffle of the second stage.

11. The method of claim 10 wherein arranging includes configuring the upstream baffle of the first stage proximate a middle of the sidewall of the second stage.

12. The method of claim 10 wherein arranging includes configuring a portion of the at least one sidewall in common with the first stage and with the second stage.

13. The method of claim 10 wherein assembling includes providing an upstream baffle substantially impervious to airflow and a downstream baffle substantially impervious to airflow.

14. A method of operating an electrostatic precipitator, comprising;

introducing air into an inlet of a chamber;

passing the air through sidewalls of a plurality of stages including at least a first stage adjacent a second stage, the plurality of stages disposed in the chamber and each stage having a plurality of discharge electrodes disposed in an interior region and bounded by an upstream baffle on an end proximate the air inlet and bounded by a downstream baffle on an end proximate the air outlet and each stage having at least one sidewall between the air inlet and the air outlet, the sidewall configured as a collection electrode and having a plurality of apertures disposed along a length between the upstream baffle and the downstream baffle, and wherein the upstream baffle of the first stage is positioned in staggered alignment relative to the upstream baffle of the second stage and the downstream baffle of the first stage is positioned in staggered alignment relative to the downstream baffle of the second stage; and discharging air from an outlet of the chamber.

15. The method of claim 14 further including ionizing the air proximate the discharge electrodes.

16. The method of claim 14 further comprising deionizing the air at the time of passing through the collection electrode.

17. The method of claim 14 wherein air proximate a downstream baffle of a first stage is passed into a second stage adjacent the first stage at a middle of a sidewall of the second stage.

18. The method of claim 14 wherein air enters a stage at a sidewall and air exits the stage at a sidewall.

19. The method of claim 14 further comprising blocking passage of air at the upstream baffle and at the downstream baffle.

20. The method of claim 14 wherein passing the air through sidewalls includes passing air through a portion of the at least one sidewall in common with the first stage and with the second stage.

* * * * *